US005887446A

United States Patent [19]

Lee

[11] Patent Number: 5,887,446

[45] Date of Patent: Mar. 30, 1999

[54] REFRIGERATOR EQUIPPED WITH A REFRIGERATOR LAMP MAGNET SWITCH

[75] Inventor: Jae-Hee Lee, Incheon, Rep. of Korea

[73] Assignee: Daewoo Electronics Co., Ltd., Seoul, Rep. of Korea

[21] Appl. No.: 870,910

[22] Filed: Jun. 6, 1997

[30] Foreign Application Priority Data

Jun. 29, 1996 [KR] Rep. of Korea ..... 1996-19198

[51] Int. Cl.[6] ..... F25D 11/02; H01H 3/16; H01H 9/00

[52] U.S. Cl. ..... 62/441; 335/206; 200/61.62

[58] Field of Search ..... 62/298, 441; 335/205, 335/206, 207; 200/61.62

[56] References Cited

U.S. PATENT DOCUMENTS 3,539,741 11/1970 Voland ..... 335/207
3,881,077 4/1975 Piber ..... 200/61.69
3,890,476 6/1975 Canter et al. ..... 200/61.62
3,895,198 7/1975 Piber ..... 200/61.62
4,241,337 12/1980 Prada ..... 340/547
5,063,372 11/1991 Gillett ..... 340/547

*Primary Examiner*—William Doerrler
*Attorney, Agent, or Firm*—Beveridge,Degrandi, Weilacher, & Young, LLP

[57] ABSTRACT

A refrigerator lamp on/off switch housing is mounted in an insulating partition of a refrigerator. The refrigerator lamp on/off switch housing is divided into an upper housing part and a lower housing part. The lower housing part has a first magnet and a first plurality of springs, and the upper housing part has a second magnet and a second plurality of springs. A third magnet is mounted on the upper side of a door of a fresh food compartment, and a fourth magnet is mounted on the lower side of a door of a freezing compartment. A fresh food compartment lamp and a freezing compartment lamp are controlled to be turned on and off by a repulsive force between the magnets and a restoring force of the springs as the doors are opened and closed.

8 Claims, 9 Drawing Sheets

200
200a
200b
210a
210b
210

2
200
210
230
230a
220
240a
240

REFRIGERATOR EQUIPPED WITH A REFRIGERATOR LAMP MAGNET SWITCH

BACKGROUND OF THE INVENTION

1. Field of the Invention

The present invention relates to a refrigerator, and more particularly to a refrigerator equipped with a magnet switch capable of turning on and off refrigerator lamps in connection with the opening and closing of the refrigerator doors.

2. Prior Art

FIG. 1 is a perspective view for showing a general refrigerator having a refrigerator lamp switch. As shown in FIG. 1, a refrigerator 1 generally comprises an upper freezing compartment 10, a lower fresh food compartment 20, an insulating partition 30, an evaporator (not shown), a fan (not shown), a door for the upper freezing compartment 70 (hereinafter, "freezer door 70") and a door for the lower fresh food compartment 60 (hereinafter, "fresh food door 60"). The upper freezing compartment 10 is a room for preserving food in a freezing manner, and the lower fresh food compartment 20 is a chamber for preserving food in a fresh state without freezing. Further, the insulating compartment 10 from the lower fresh food compartment 20. The evaporator is mounted in a rear side of the refrigerator 1 and converts air flown thereinto to refrigerated air through heat-exchange. The fan is mounted over the evaporator and circulates the refrigerated air through the freezing compartment 10 and the fresh food compartment 20. The fresh food door 70 and the freezer door 60 are used to open and close the freezing compartment 10 and the fresh food compartment 20, respectively. The refrigerator 1 has a freezing compartment lamp 25, a fresh food compartment lamp 27, and a refrigerator lamp switch 29. The freezing compartment lamp 25 is mounted on one side of the freezing compartment 10 to light the freezing compartment 10, and the fresh food compartment lamp 27 is mounted on one side of the fresh food compartment 20 to light the fresh food compartment 20. The refrigerator lamp switch 29 is mounted in the insulating partition 30 in contact with the freezer door 60 and the fresh food door 70, and turns on and off in accordance with opening and closing of the freezer door 60 and the fresh food door 70. The freezing compartment lamp 25 and/or the fresh food compartment lamp 27 turns on and/or off when the refrigerator lamp switch 29 turns on and off in accordance with the opening and closing of the freezer door 60 and/or the fresh food door 70.

FIG. 1A is an enlarged view for showing a portion of a conventional refrigerator lamp switch, and FIG. 2 is a view for schematically showing a structure of the conventional refrigerator lamp switch of FIG. 1. As shown in FIGS. 1A and 2, one end of the freezer door 60 has a first protrusion 60*a* which protrudes downwardly, and one end of the fresh food door 70 has a second protrusion 70*a* which protrudes upwardly toward the first protrusion 60*a*. The refrigerator lamp switch 29 has a front panel 119. First and second protrusion bars 120*a* and 120 protrude out through the front panel 119 toward the first and second protrusions 60*a* and 70*a*. First and second cylindrical caps 130*a* and 130*b* are fixedly inserted into the other ends of the first and second protrusion bars 120*a* and 120, respectively. First and second cap protrusions 131*a* and 131*b* protrude from the outer peripheral surfaces of the first and second cylindrical caps 130*a* and 130*b*, respectively. The first and second cap protrusions 131*a* and 131*b* have a step portions 132*a* and 132*b* thereon, respectively. The first and second protrusion bars 120*a* and 120 are supported by guiding plates 111*a* and 111*b*, respectively. The bottom surfaces of the first and second cylindrical caps 130*a* and 130*b* are connected to the ends of first and second springs 140*a* and 140*b* respectively. The other ends of the first and second springs 140*a* and 140*b* are each connected to one side of a switch box 150. The switch box 150 is mounted in the insulating partition 30. First, second, third and fourth terminals 133*a*, 133*b*, 133*c* and 133*d* each of which is a metal strip are provided in the switch box 150. The first to fourth terminals 133*a*, 133*b*, 133*c* and 133*d* are fixed at a certain distance and parallel with one another by a terminal fixing part 141. Two pairs of electric wires 133*e* and 133*f* connect the freezing compartment lamp 25 and the fresh food compartment lamp 27 with the ends of the first to fourth terminals 133*a*, 133*b*, 133*c* and 133*d*. The step portion 132*a* of the first cap protrusion 131*a* supports the first terminal 133*a*, and the step portion 132*b* of the second cap protrusion 131*b* supports the fourth terminal 133*d*. A contact part 118 is mounted between a bent portion 133*aa* of the first terminal 133*a* and a bent portion 133*da* of the fourth terminal 133*d*. Both ends of the contact part 118 are each bent to form a first bent portion 118*a* and a second bent portion 118*b* of the contact part 118. The first to fourth terminals 133*a*, 133*b*, 133*c* and 133*d* and the first and second bent portion 118*a* and 118*b* are elastic.

FIGS. 3A and 3B are views for explaining operations of the refrigerator lamp switch of FIG. 2 when the fresh food door is opened and closed. As shown in FIG. 3A, when the fresh food door 70 is closed, the second protrusion 70*a* presses the second protrusion bar 120 which protrudes beyond the panel 119. At this time, the second protrusion bar 120 moves in the direction of arrow A. The movement of the second protrusion bar 120 in the direction of arrow A causes the step portion 132*a* of the first cap protrusion 131*a* to move inwardly in the direction of arrow A while supporting the first terminal 133*a*. The movement of the first cap protrusion 131*a* causes the bent portion 133*aa* of the first terminal 133*a* to move in the direction of arrow C so as to disconnect the first bent portion 118*a* from the bent portion 133*aa*. Further, the movement of the first cap protrusion 131*a* causes the spring 140*a* to contract. Due to the disconnection of the first bent portion 118*a* from the bent portion 133*aa*, the pair of electric wires 133*e* are disconnected from each other which connect the fresh food compartment lamp 27 with the first and second terminals 133*a* and 133*b* (referring to FIG. 2). Accordingly, the fresh food compartment lamp 27 turns off. When the freezer door 60 is closed, the freezing compartment lamp 25 turns off by the same operations of the first protrusion bar 120*a*, and the third and fourth terminals 133*c* and 133*d* as mentioned above. Therefore, explanation on the interaction of the first protrusion 60*a* of the freezer door 60, the first protrusion bar 120*a*, the third and fourth terminals 133*c* and 133*d*, the spring 140*b* and the pair of electric wires 133*f* is omitted.

FIG. 3B is a view for explaining operations of the refrigerator lamp switch of FIG. 2 when the fresh food door is opened. As shown in FIG. 3B, when the fresh food door 70 is opened, the second protrusion 70*a* releases the pressing of the second protrusion bar 120 which protrudes outward from the panel 119. At this time, the second protrusion bar 120 moves in the direction of arrow B. The movement of the second protrusion bar 120 in the direction of arrow B causes the step portion 132*a* of the first cap protrusion 131*a* to move in the direction of arrow B while supporting the first terminal 133*a*. The movement of the first cap protrusion 131*a* causes the bent portion 133*aa* of the first terminal 133*a* to move in the direction of arrow D to contact the first bent portion 118*a* with the first terminal 133*a*. Further, due to the movement of the first cap protrusion 131*a,* the spring 140*a* is restored from its contraction. When the first bent portion 118*a* is in contact with the bent portion 133*aa,* the pair of electric wires 133*e* are connected with each other so that the fresh food compartment lamp 27 is electrically connected with the first and second terminal 133*a* and 133*b* (referring to FIG. 2). Therefore, the fresh food compartment lamp 27 turns on. When the freezer door 60 is opened, the freezing compartment lamp 25 turns on by the same operations of the first protrusion bar 120*a,* and the third and fourth terminals 133*c* and 133*d* as mentioned above. Therefore, explanation on the interaction of the first protrusion 60*a* of the freezer door 60, the first protrusion bar 120*a,* the third and fourth terminals 133*c* and 133*d,* the spring 140*b,* and the pair of electric wires 133*f* is omitted.

However, the conventional refrigerator lamp switch as mentioned above has drawbacks in that the production cost increases since the conventional refrigerator lamp switch has difficulties in the assembling process due to its complicated structure and the freezer door and the fresh food door each have a protrusion for pressing its protrusion bar.

SUMMARY OF THE INVENTION

It is an object of the present invention to provide a refrigerator equipped with a refrigerator lamp magnet switch capable of turning on and off refrigerator lamps in connection with opening and closing of the refrigerator doors.

In order to attain the above, the refrigerator equipped with a refrigerator lamp magnet switch according to the present invention comprises an insulating partition, a refrigerator lamp switch housing, a switch panel, a division plate for the refrigerator lamp housing, a first switching part, and a second switching part. Further, third and fourth magnets are mounted in a fresh food door and a freezing door of the refrigerator doors, respectively.

The insulating partition divides the inside of a refrigerator to form an upper freezing compartment and a lower fresh food compartment and has a groove for the refrigerator lamp switch housing on the side of the insulating partition facing the fresh food door and the freezing door. The refrigerator lamp switch housing is fixedly inserted in the groove and has a shape of a hexahedron with one side uncovered. The switch panel covers the uncovered side of the refrigerator lamp switch housing and is fixed to the insulating partition. The division plate is mounted in the refrigerator lamp switch housing to divide an upper housing part and a lower housing part. The first switching part is mounted in the lower housing part, equipped with a first magnet and a first plurality of springs, and moved back and forth in the refrigerator as the fresh food door is opened and closed, so as to turn the electric power on and off, to thereby switch the refrigerator lamps on and off. The fresh food door has a third magnet on an upper portion thereof in order to generate a first repulsive force between the first and third magnets when the fresh food door is closed. The freezing door has a fourth magnet on a lower portion thereof in order to generate a second repulsive force between the second and fourth magnets when the freezing door is closed. The back and forth movements of the first and second switching parts are accomplished by the first and second repulsive force and restoring force of the first and second plurality of springs.

The first switching part has a first magnet receiving part, a fresh food compartment lamp on/off switch part, and a first plurality of connection parts. The first magnet receiving part accommodates the first magnet and moves back and forth in the refrigerator by the first repulsive force and the restoring force of the first plurality of springs as the fresh food door is opened and closed. The fresh food compartment lamp on/off switch part has the first plurality of springs and turns on and off the refrigerator lamps as the first magnet receiving part moves back and forth.

The first plurality of springs are contracted and restored as the first magnet receiving part moves back and forth. One end of each of the first plurality of connection parts is fixed to the first magnet receiving part, and the other end of each of the first plurality of connection parts is inserted into the fresh food compartment lamp on/off switch part. The first plurality of springs are contracted by the other ends of the first plurality of connection parts as the first magnet receiving part moves back and forth in the refrigerator.

A second switching part has a second magnet receiving part, a freezing compartment lamp on/off switch part, and a second plurality of connection parts. The second magnet receiving part accommodates the second magnet and moves back and forth in the refrigerator by the second repulsive force and restoring force of the second plurality of springs as the fresh food door is opened and closed. The freezing compartment lamp on/off switch part receives the second plurality of springs, and turns on and off the freezing compartment lamp as the second magnet receiving part moves back and forth. The second plurality of springs are contracted and restored as the second magnet receiving part moves back and forth. One end of each of the plurality of connection parts is fixed to the second magnet receiving part, and the other end of the plurality of connection parts is movably inserted into the freezing compartment lamp on/off switch part. The second plurality of springs are contracted by the other ends as the second magnet receiving part moves back and forth in the refrigerator.

BRIEF DESCRIPTION OF THE DRAWINGS

These and other objects and features of the present invention can be understood through the following embodiment by reference to the accompanying drawing, in which:

FIG. 1A is an enlarged view for showing a portion of a conventional refrigerator lamp switch;

DETAILED DESCRIPTION OF THE PREFERRED EMBODIMENT

Hereinafter, a refrigerator equipped with a refrigerator lamp magnet switch according to the embodiment of the present invention will be described in detail with reference to the accompanying drawings.

Figure 1:
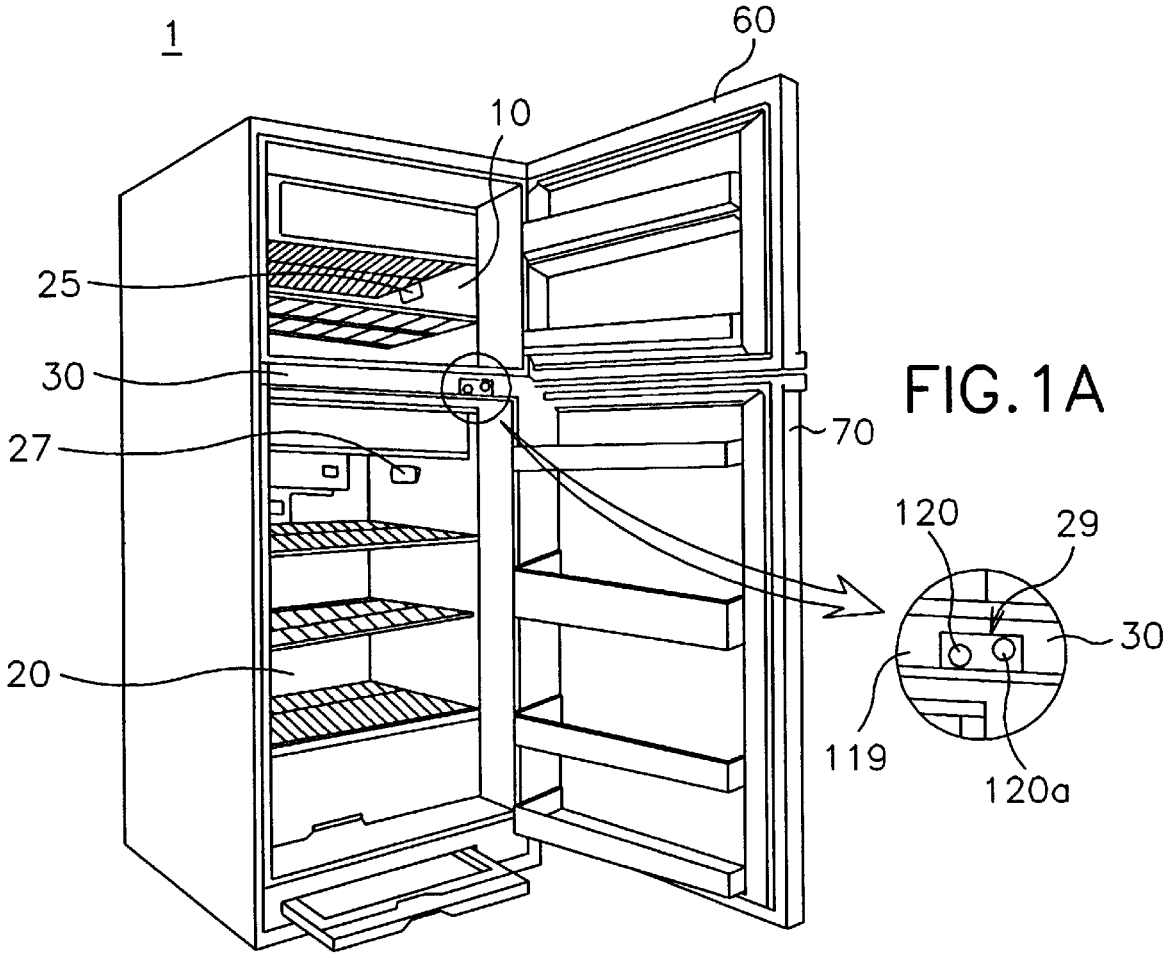
FIG. 1 PRIOR ART
FIG. 1 is a perspective view for showing a general refrigerator having a refrigerator lamp switch.
Figure 2:
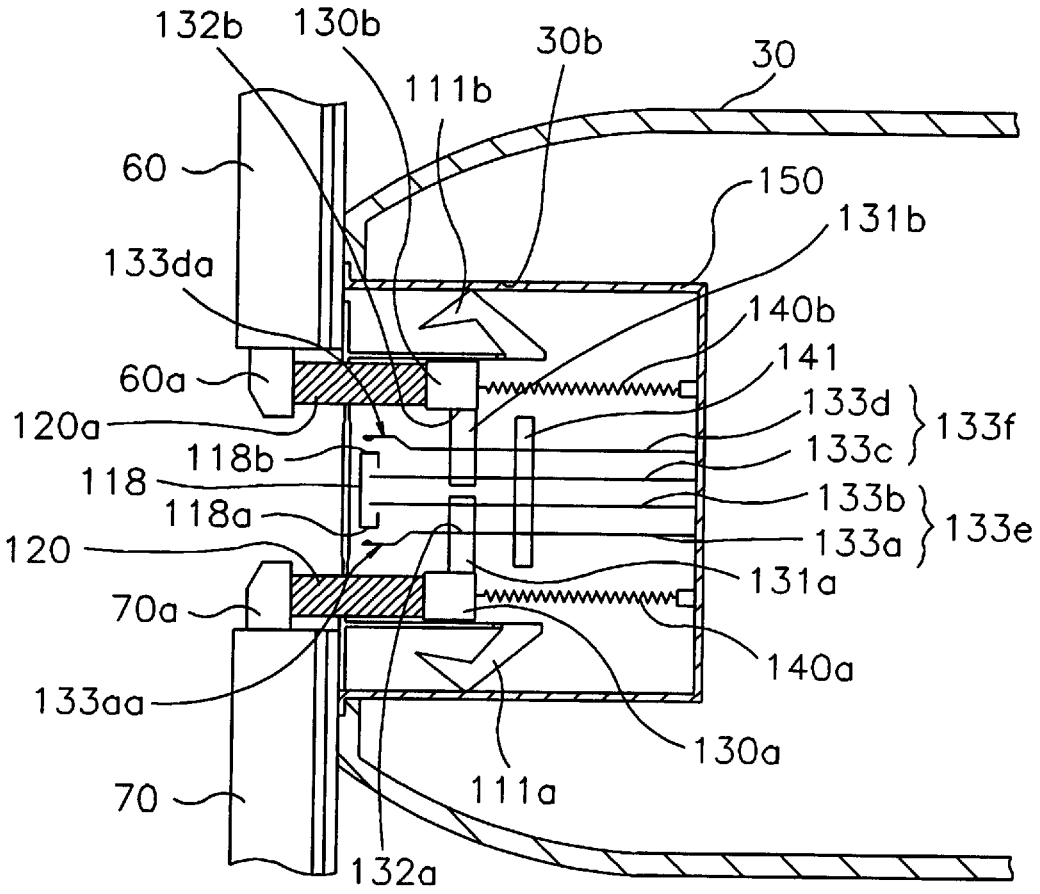
FIG. 2 PRIOR ART
FIG. 2 is a view for schematically showing a structure of the conventional refrigerator lamp switch of FIG. 1.
Figure 3A:
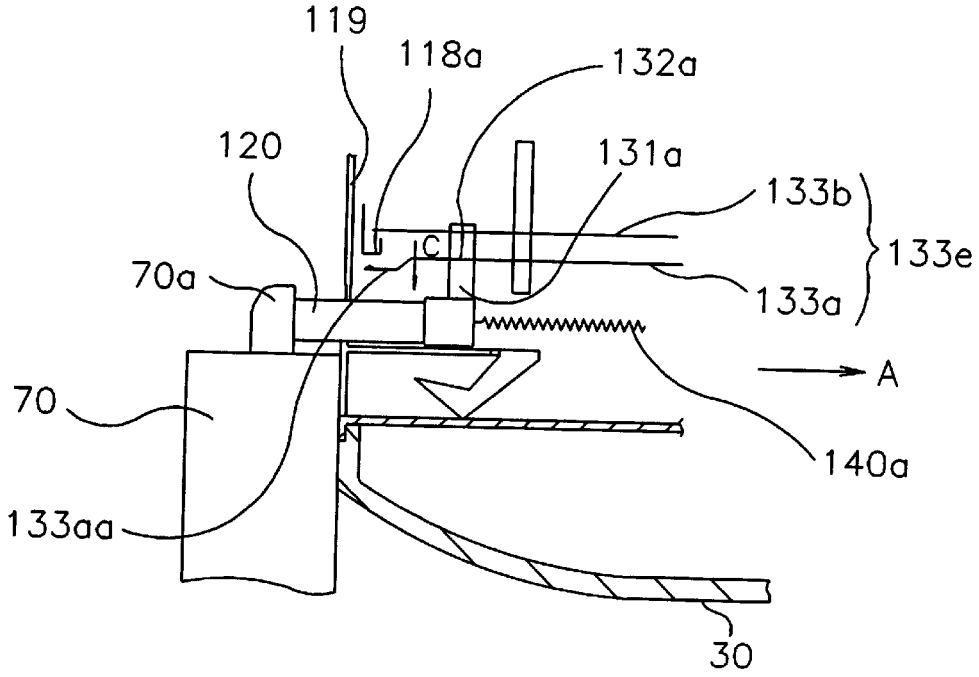
FIG.3A PRIOR ART
FIG. 3A is a view for explaining operations of the refrigerator lamp switch of FIG. 2 when the fresh food door is closed.
Figure 3B:
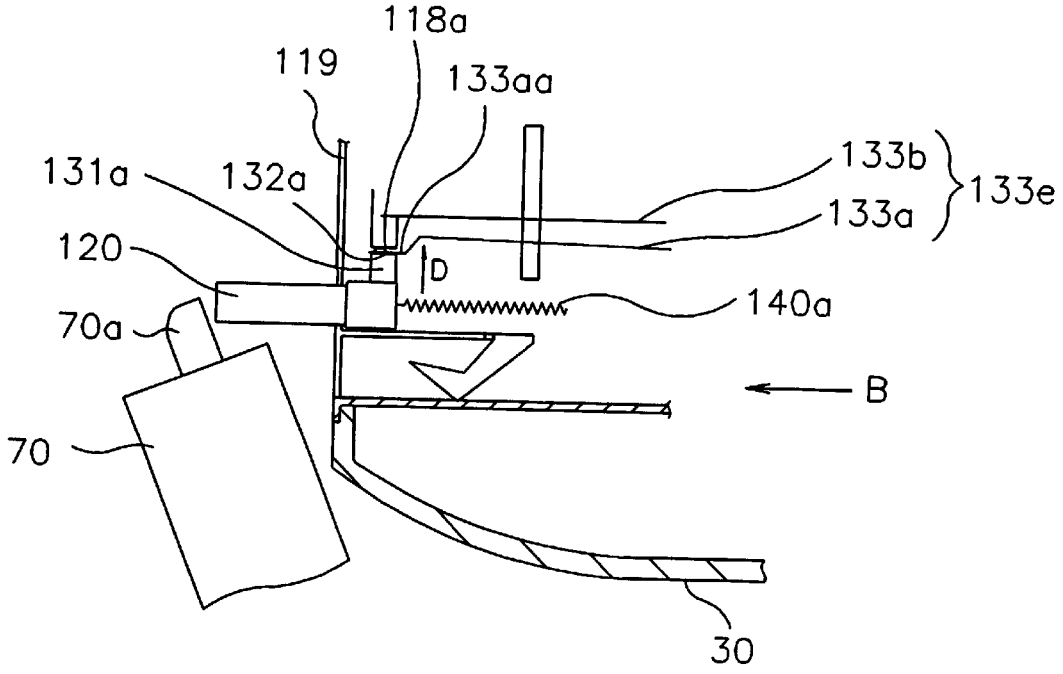
FIG.3B PRIOR ART
FIG. 3B is a view for explaining operations of the refrigerator lamp switch of FIG. 2 when the fresh food door is opened.
Figures 4, 4A:
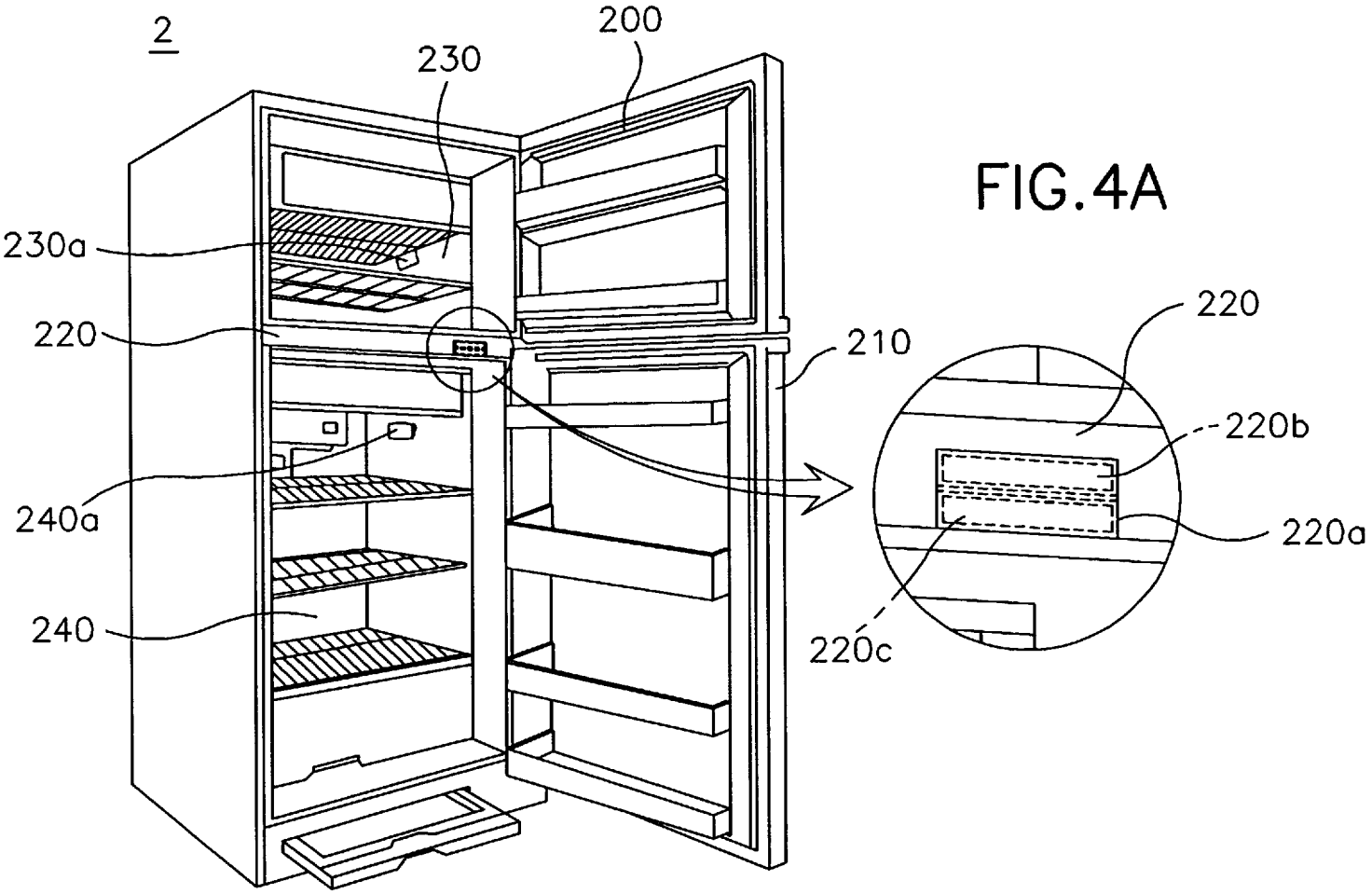
FIG. 4 is a perspective view for showing a refrigerator equipped with a refrigerator lamp magnet switch according to an embodiment of the present invention.
FIG. 4A is an enlarged view for showing a front panel of FIG. 4.

FIG. 4 is a perspective view for showing a refrigerator equipped with a refrigerator lamp magnet switch according to an embodiment of the present invention. As shown in FIG. 4, a refrigerator 2 comprises a freezing compartment 230, a fresh food compartment 240, a door for the freezing compartment (hereinafter, "freezing door") 200, a door for the fresh food compartment (hereinafter, "fresh food door") 210, an insulating partition 220, a freezing compartment lamp 230*a,* and a fresh food compartment lamp 240*a.* The insulating partition 220 divides the inside of the refrigerator 2 to form the freezing compartment 200 and the fresh food compartment 240. Further, as in the refrigerator 1 shown in FIG. 2, a receiving groove 30*b* is formed on one side of the insulating partition 220 in the the refrigerator 2 shown in FIGS. 4, 6A, and 6B.

Figures 4B, 4C:
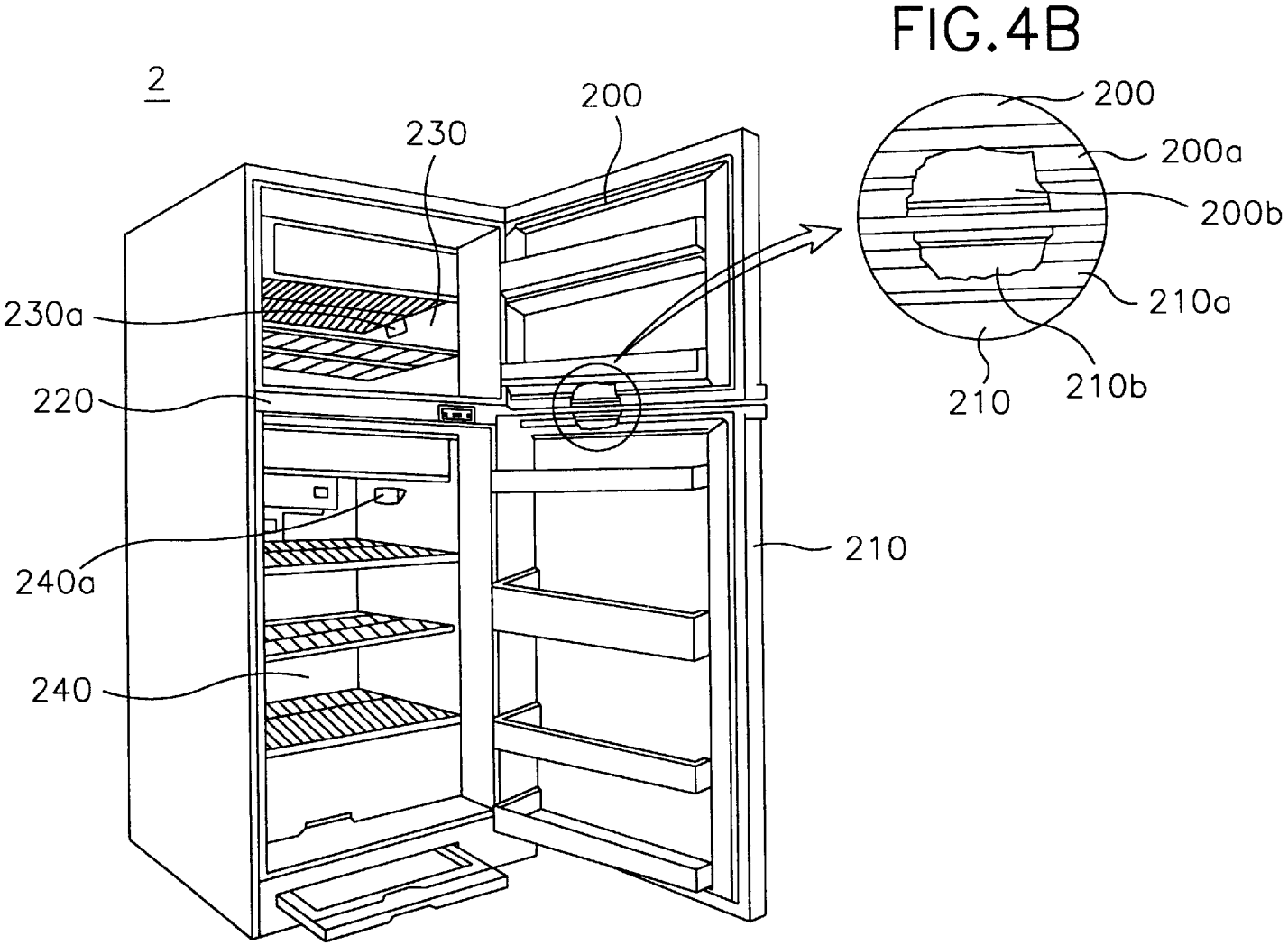
FIG. 4B is an enlarged view for showing portions of a fresh food door and a freezing door of FIG. 4.
Figure 5A:
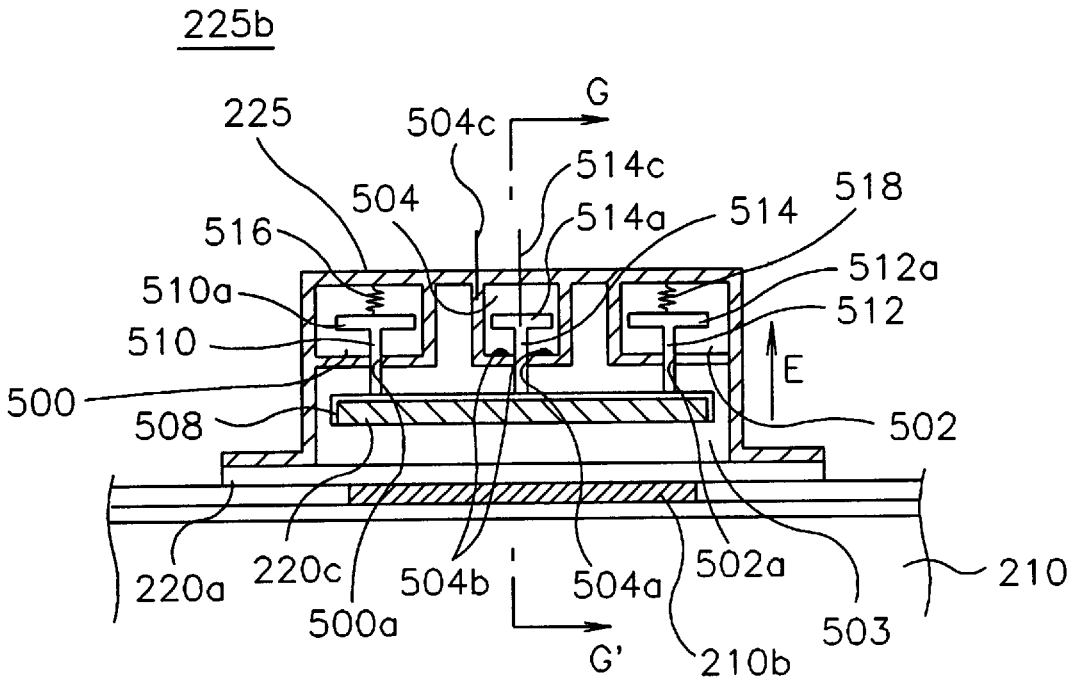
FIG. 5A is a view for explaining operations of the refrigerator lamp magnet switch of FIG. 4 when the fresh food door is closed.
Figure 5B:
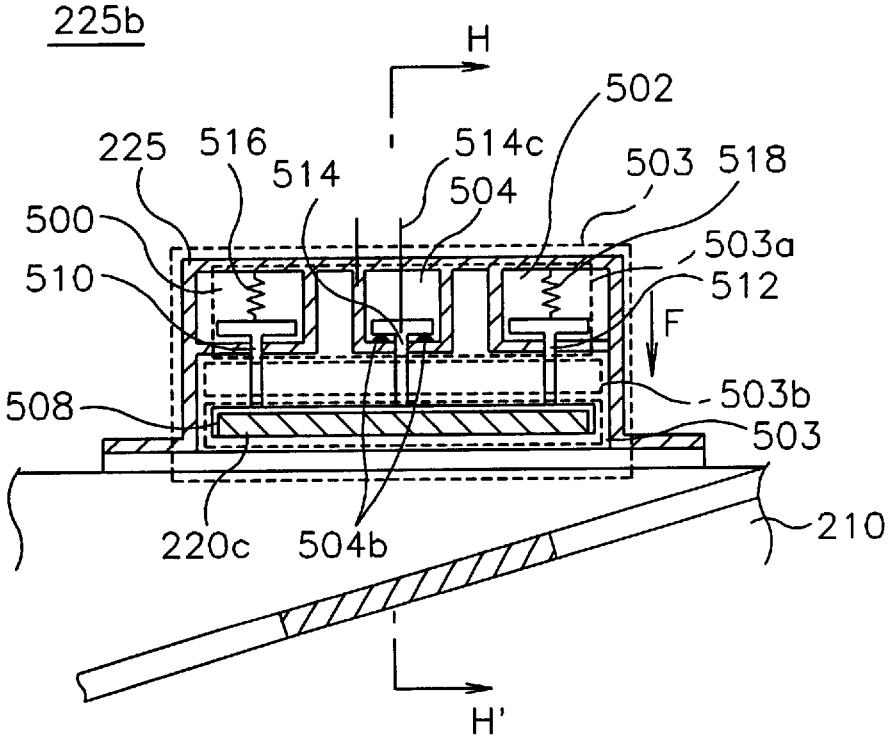
FIG. 5B is a view for explaining operations of the refrigerator lamp magnet switch of FIG. 4 when the fresh food door is opened.

Referring to FIG. 4 again, a refrigerator lamp switch housing 225 formed in a hexahedron with one side open is inserted in the receiving groove 30*b*. A rectangular switch panel 220*a* is mounted on the front side of the insulating partition 220, and the switch panel 220*a* covers the open side of the refrigerator lamp switch housing 225. As shown in FIGS. 4, and 4A, first and second magnets 220*c* and 220*b* are mounted in the refrigerator lamp switch housing 225. Further, as shown in FIG. 4B, a first gasket 210*a* is mounted in the upper portion of the fresh food door 210, and a second gasket 200*a* is mounted in the lower portion of the freezing door 200. A third magnet 210*b* is mounted in the first gasket 210*a* to correspond with the first magnet 220*c*. Further, the third magnet 210*b* is fixed to the fresh food door 210. A fourth magnet 200*b* is mounted in the second gasket 200*a* to correspond with the second magnet 220*b*. Further, the fourth magnet 200*b* is fixed to the freezing door 200. Accordingly, when the freezing door 200 is closed, the freezing door 200 seals the freezing compartment 230 and pushes the second magnet 220*b* which is in the switch panel 220*a* into the refrigerator lamp switch housing 225 by a repulsive force between the second and fourth magnets 220*b* and 200*b*. Further, when the fresh food door 210 is closed, the fresh food door 210 seals the fresh food compartment 240 to push the first magnet 220*c* into the refrigerator lamp switch housing 225 by a repulsive force between the first and third magnets 220*c* and 210*b*. FIG. 5A is a view for explaining operations of the refrigerator lamp magnet switch of FIG. 4 when the fresh food door is closed, and FIG. 5B is a view for explaining operations of the refrigerator lamp magnet switch of FIG. 4 when the fresh food door is opened, FIG. 6A is a cross-sectional view taken along line G-G' in FIG. 5A, viewed in the indicated direction, and FIG. 6B is a cross-sectional view taken along line H-H' in FIG. 5B, viewed in the indicated direction.

Figure 6A:
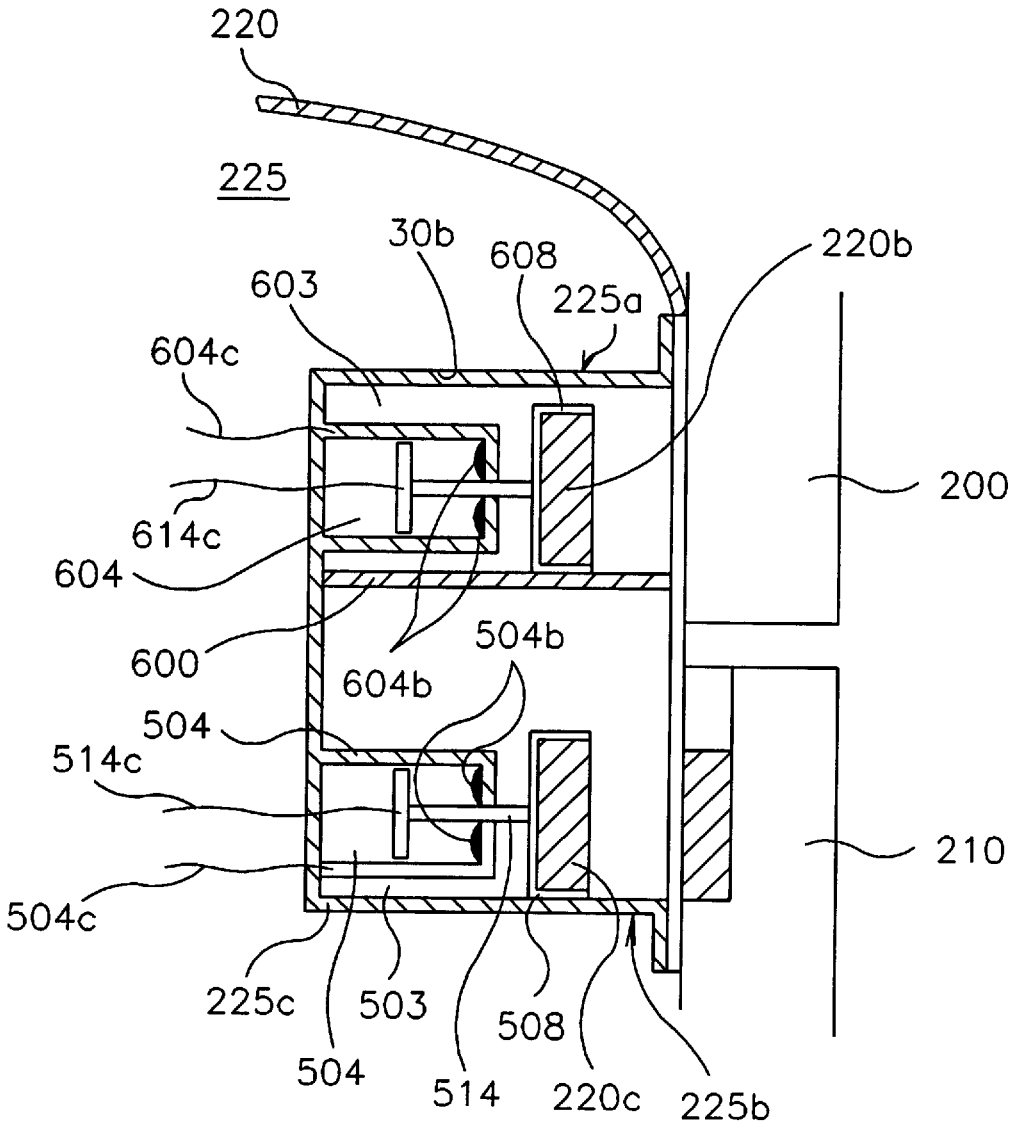
FIG. 6A is a cross-sectional view taken along line G-G' in FIG. 5A, viewed in the indicated direction.
Figure 6B:
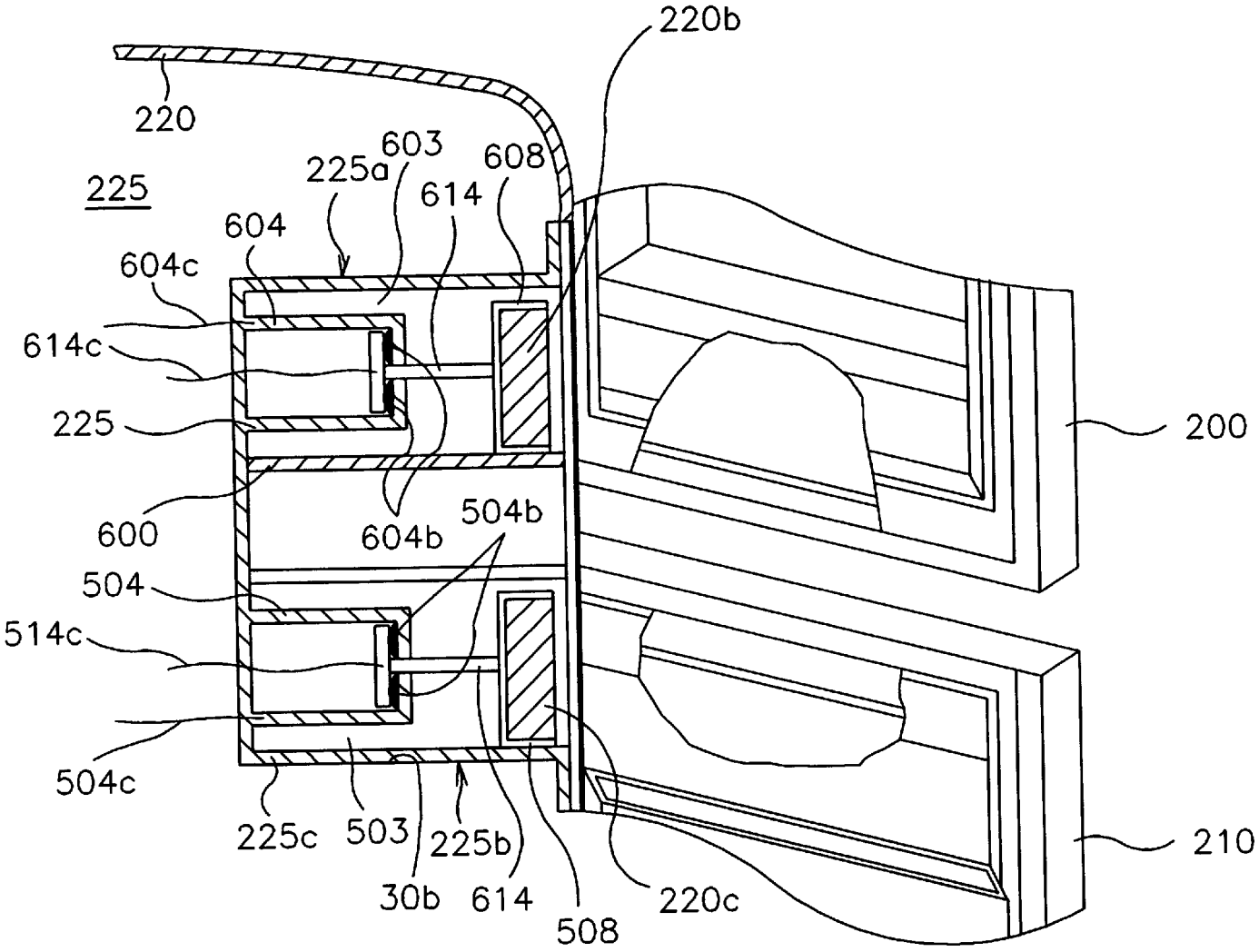
FIG. 6B is a cross-sectional view taken along line H-H' in FIG. 5B, viewed in the indicated direction.

As shown in FIGS. 6A and 6B, a switch housing division plate is mounted in the refrigerator lamp switch housing 225 to divide the refrigerator lamp switch housing 225 into an upper housing part 225*a* and a lower housing part 225*b*. The switch housing division plate is a second magnet receiving part support plate 600 for supporting the second magnet receiving part 608 which will be described later. That is, the refrigerator lamp switch housing 225 is divided into the upper housing part 225*a* and the lower housing part 225*b*.

Figure 5C:
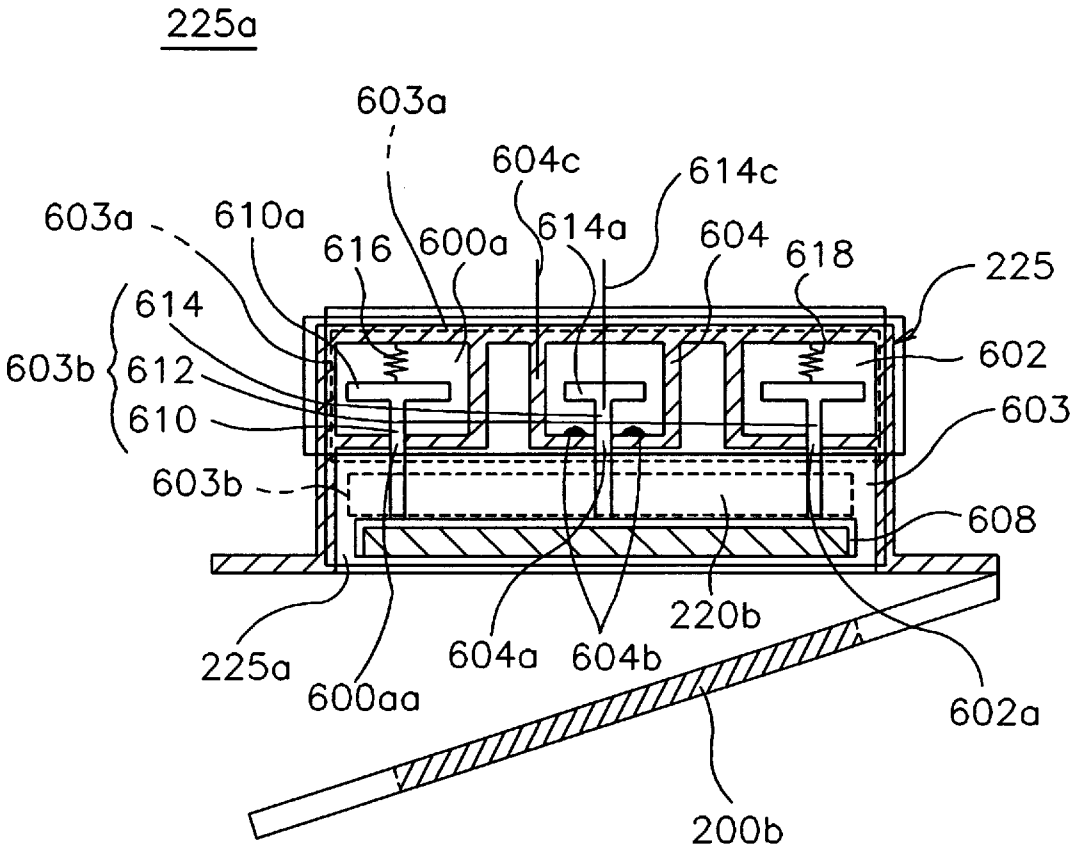
FIG. 5C is a view for explaining operations of the refrigerator lamp magnet switch of FIG. 4 when the freezing door is closed.

As shown in FIG. 5A, the lower housing part 225*b* comprises a first magnet 220*c,* a first magnet receiving part 508, a first connection part 510, a second connection part 512, a third connection part 514, a first connection part receiving part 500, a second connection part receiving part 502, a third connection part receiving part 504, a first spring 516, and a second spring 518. FIG. 5C is a view for explaining operations of the refrigerator lamp magnet switch of FIG. 4 when the freezing door is closed. As shown in FIG. 5C, the upper housing part 225*a* comprises a second magnet 220*b,* the second magnet receiving part 608, a fourth connection part 610, a fifth connection part 612, a sixth connection part 614, a fourth connection part receiving part 600*a,* a fifth connection part receiving part 602, a sixth connection part receiving part 604, a third spring 616, and a fourth spring 618.

A first switching part 503 is constituted in the lower housing part 225*b*. The first switching part 503 has the first magnet 220*c* and a first plurality of springs. The first plurality of springs are constituted with the first spring 516 and the second spring 518. The first switching part 503 moves back and forth in the insulating partition 220 as the fresh food door 210 is opened and closed. The movements of the first switching part 503 switch electric power on and off to turn the fresh food compartment lamp 240*a* on and off.

The third magnet 210*b* is provided on the upper portion of the fresh food door 210 to generate the first repulsive force between the third magnet 210*b* and the first magnet 220*c* when the fresh food door 210 is closed. A second switching part 603 is provided in the upper housing part 225*a*.

The second switching part 603 has the second magnet 220*b* and a second plurality of springs. The second plurality of springs include the third spring 616 and the fourth spring 618. The second switching part 603 moves back and forth in the upper housing part 225*a* as the fresh food door 210 is opened and closed. The movements of the second switching part 603 turn the freezing compartment lamp 230*a* on and off by switching electric power on and off.

The fourth magnet 200*b* is provided on the lower portion of the freezing door 200 to generate a second repulsive force between the second magnet 220*b* and the fourth magnet 200*b* when the freezing door 200 is closed.

The first switching part 503 has a first magnet receiving part 508, a fresh food compartment lamp on/off switch part 503*a,* and a first plurality of connection parts 503*b.*

The first magnet receiving part 508 is in a rectangular shape which accommodates the first magnet 220*c.*

The first magnet receiving part 508 receives the first magnet 220*c,* and moves back and forth in the upper housing part 225*b* by the first repulsive force and the restoring force of the first plurality of springs as the fresh food door 210 is opened and closed.

The fresh food compartment lamp on/off switch part 503*a* includes the first connection part receiving part 500, the second connection receiving part 502, and the third connection receiving part 504.

The first connection part receiving part 500 accommodates the other end of the first connection part 510 to be moved back and forth therein. The first spring 516 is disposed between the first rear side of the first connection receiving part 500 and the other end of the first connection part 510. The first rear side is a portion of the refrigerator lamp switch housing 225. The second connection receiving part 502 accommodates the other end of the second connection part 512 to be moved back and forth. The second spring 518 is mounted between the second rear side of the second connection part receiving part 502 and the other end of the second connection part 512. The second rear side is a portion of the refrigerator lamp switch housing 225.

The third connection receiving part 504 accommodates the other end of the third connection part 514 to be moved back and forth and is made of conductive material. The other end of the third connection part 514 is connected with the fresh food compartment lamp 240*a* through a first electric wire 514*c*. The other end of the third connection part 514 is made of a conductive material such as metal. Further, a front side of the third connection part receiving part 504 is one that is parallel with the first and second rear sides. The front side of the third connection part receiving part 504 has small metal protrusions 504*b*. The third connection part receiving part 504 is connected with a second electric wire 504*c* which electrically combines the third connection part receiving part 504 and electric power supply (not shown). The fresh food compartment lamp 240*a* is turned on and off by contact with and contact release from the other end of the third connection part 514 and the small metal protrusions 504*b*.

Referring to FIG. 5C, the second switching part 603 has the second magnet receiving part 608, fresh food compartment lamp on/off switch part 603*a*, and the second plurality of connection parts 603*b*. *The second magnet receiving part 608 is formed in a retangular shape which accommodates the second magnet 220b*. Further, the second magnet receiving part 608 accommodates the second magnet 220*b* and moves back and forth in the upper housing part 225*a* by the second repulsive force and the restoring force of the second plurality of springs as the freezing door 200 is opened and closed.

The freezing compartment lamp on/off switch part 603*a* has the fourth connection part receiving part 600*a*, the fifth connection part receiving part 602, and the sixth connection part receiving part 604.

The fourth connection part receiving part 600*a* accommodates the other end of the fourth connection part 610 to move back and forth. The third spring 616 is disposed between the fourth rear side of the fourth connection part receiving part 600*a* and the other end of the fourth connection part 610. The fourth rear side of the fourth connection part receiving part 600*a* is a portion of the rear side of the refrigerator lamp switch housing 225.

The fifth connection part receiving part 602 accommodates the other end of the fifth connection part 612 to move back and forth. The fourth spring 618 is mounted between the fifth rear side of the fifth connection part receiving part 602 and the other end of the fifth connection part 612. The fifth rear side of the fifth connection part receiving part 602 is a portion of the refrigerator lamp switch housing 225. The sixth connection part receiving part 604 movably accommodates the other end of the sixth connection part 604. An electric wire 614*c* is provided to connect the other end of the sixth connection part 604 with the freezing compartment lamp 230*a*. The other end of the sixth connection part 614 is made of a conductive material. Further, a front side of the sixth connection part 604 is one that is parallel with the first and second rear sides. The front side of the third connection part receiving part 604 has small metal protrusions 604*b*. The sixth connection part receiving part 604 is connected with a third electric wire 604*c* which electrically connects the sixth connection part receiving part 604 and electric power supply (not shown). The freezing compartment lamp 230*a* is turned on and off by contact with and contact release from the other end of the sixth connection part 614 and the small metal protrusions 604*b*. The fresh food door 210 is provided with the third magnet 210*b*, and as shown in FIG. 5A, the third magnet 210*b* corresponds to the first magnet 220*c* when the fresh food door 210 is closed. The first to sixth connection part receiving part 500, 502, 504, 600*a*, 602, and 604 each have a retangular shape. The first to third connection part receiving parts 500, 502, and 504 have a first hole 500*a*, a second hole 502*a*, and a third hole 504*a*, respectively, on the front sides thereof each of which faces the first magnet receiving part 508, and the fourth to sixth connection part receiving parts 600*a*, 602, and 604 have a fourth hole 600*aa*, a fifth hole 602*a*, and a sixth hole 604*a*, respectively, on the front sides thereof each of which faces the second magnet receiving part 608. One end of the first connection part 510 has a round head portion 510*a* whose diameter is bigger than that of the first hole 500*a*. The first connection part 510*a* is inserted in the first connection part receiving part 500 through the first hole 500*a* in order that the round head portion 510*a* is inside the first connection part receiving part 500, and the other end of the first connection part 510 is fixed to the first magnet receiving part 508. One end of the fourth connection part 610 has a round head portion 610*a* whose diameter is bigger than that of the fourth hole 600*aa*. The fourth connection part 610 is inserted in the fourth connection part receiving part 600*a* through the fourth hole 600*aa* in order that the round head portion 610*a* is inside the fourth connection part receiving part 600*a*, and the other end of the fourth connection part 610 is fixed to the second magnet receiving part 608. One end of the second connection part 512 has a round head portion 512*a* whose diameter is bigger than that of the second hole 502*a*. The second connection part 512 is inserted in the second hole 502*a* in order that the round head portion 512*a* is inside the second connection part receiving part 600*a*, and the other end of the second connection part 512 is fixed to the first magnet receiving part 508. One end of the fifth connection part 612 has a round head portion 612*a* whose diameter is bigger than that of the fifth hole 602*a*. The fifth connection part 612 is inserted in the fifth connection part receiving part 602, and the other end of the fifth connection part 602*a* is fixed to the second magnet receiving part 608. One end of the third connection part 514 has a round head portion 514*a* whose diameter is bigger than that of the third hole 504*a*. The third connection part 514 is inserted in the third connection part receiving part 504 in order that the round head portion 514*a* is inside the third hole 504*a*, and the other end of the third connection part 508 is fixed to the first magnet receiving part 508. One end of the sixth connection part 614 has a round head portion 614*a* whose diameter is bigger than that of the sixth hole 604*a*. The sixth connection part 614 is inserted in the sixth connection part receiving part 604 in order that the round head portion 614*a* is inside the sixth connection part receiving part 604, and the other end of the sixth connection part 614 is fixed to the second magnet receiving part 608.

Accordingly, the other ends of the first to third connection parts 510, 512, and 514 are fixed to the first magnet receiving part 508 in a row, and the other ends of the fourth to sixth connection parts 610, 612, and 614 are fixed to the second magnet receiving part 608 in a row.

The first spring 516 is mounted inside the first connection part receiving part 500. That is, the first spring 516 is disposed between the head portion 510*a* of the first connection part 510 and the rear side of the first connection part receiving part 500. The second spring 518 is mounted inside the second connection part receiving part 502. The second spring 518 is disposed between the head portion 512*a* of the second connection part 512 and the rear side of the second connection part receiving part 502. The rear sides refer to portions of one side of the first and second connection part receiving parts 500 and 502 which face the first and second holes 500*a* and 502*a*. That is, the one side refers to the rear side of the refrigerator lamp switch housing 225.

The small metal protrusions 504*b* (refer to FIG. 5B) are formed around the third hole 504*a* on the inner surface of the front side of the third connection part receiving part 504 to be easily contacted with the head portion 514*a* of the third connection part 514. The first magnet 220*c* is fixedly accommodated in the first magnet receiving part 508 as opposed to the switch panel 220*a*.

The third connection part receiving part 504 and the head portion 514*a* of the third connection part 514 are made of a conductive material, respectively. The electric wire 504*c* is connected to the third connection part receiving part 504, and the head portion 514*a* of the third connection part 514 is connected to the electric wire 514*c*. The electric wires 504*c* and 514*c* are connected to the electric power supply (not shown) and the fresh food compartment lamp 27. Accordingly, as the head portion 514*a* is in contact with or released from contact with the metal protrusions 504*b*, the fresh food compartment lamp 27 is turned on or off.

Referring to FIG. 6A, the second magnet receiving part supporting part 600 is mounted between the rear side of the refrigerator lamp switch housing 225 and the switch panel 220*a*. The second magnet receiving part supporting part 600 is made of a nonconductive material.

As shown in FIGS. 5A and 5B, and FIGS. 6A and 6B, the upper housing part 225*a* of the refrigerator lamp switch housing 225 has the same structure as mentioned above. In the upper housing part 225*a*, the second magnet receiving part 608 having the same structure as the first magnet receiving part 508 accommodates the second magnet 220*b*. The second magnet 220*b* corresponds to the fourth magnet 200*b* of the freezing door 200 when the fresh food door 200 is closed.

As the fresh food door 210 is opened and closed, the first magnet receiving part 508 moves back and forth by the first repulsive force between the first and third magnets 220*c* and 210*b* and the restoring force of the first and second springs 516 and 518 while supported by a lower side 225*c* of the refrigerator lamp switch housing 225.

In the meantime, as the freezing door 200 is opened and closed, the second magnet receiving part 608 moves back and forth by the second repulsive force between the second and fourth magnets 220*b* and the restoring force of the third and fourth springs 616 and 618. The third and fourth springs 616 and 618 have the same structures and operations as the first and second springs 516 and 518 have.

Operations of the refrigerator equipped with a refrigerator lamp magnet switch as mentioned above will be in detail described hereinafter.

FIG. 5A is a view for explaining operations of the refrigerator lamp magnet switch of FIG. 4 when the fresh food door is closed, and FIG. 5B is a view for explaining operations of the refrigerator lamp magnet switch of FIG. 4 when the fresh food door is opened. Further, FIG. 6A is a cross-sectional view taken along line G-G' in FIG. 5A, viewed in the indicated direction, and FIG. 6B is a cross-sectional view taken along line H-H' in FIG. 5B, viewed in the indicated direction.

As shown in FIGS. 5A and 6A, when the fresh food door 210 is closed, the third magnet 210*b* of the fresh food door 210 directly faces the first magnet 220*c* of the lower housing part 225*b*. Since the first and third magnets 220*c* and 210*b* face in the same magnetic polarity to each other, a repulsive force, which is referred to as the first repulsive force, is generated between the first and third magnets 220*c* and 210*b*. Therefore, the first magnet receiving part 508 retreats in the direction of arrow E of FIG. 5A, that is, in the direction toward the rear side of the refrigerator lamp switch housing 225.

Therefore, the first to third connection parts 510, 512, and 514 which are connected to the first magnet receiving part 508 retreat in the same direction of arrow E. When the first and second connection parts 510 and 514 retreats in the direction of arrow E, the first and second springs 518 contract. The head portion 514*a* of the third connection part 514 is released from the metal protrusions 504*b*. Accordingly, the electric wires 504*c* and 514*c* are disconnected from each other to cause the refrigerator lamp 240*a* to be turned off. At this time, as shown in FIG. 5B and FIG. 5B, the first repulsive force between the first and third magnets 220*c* and 210*b* is eliminated when the fresh food door 210 is opened. As the repulsive force is eliminated, the first and second springs 516 and 518 are restored from contraction thereof.

Accordingly, the first and second connection parts 510 and 512 move in the direction of arrow F as shown in FIG. 5B. The movements of the first and second connection parts 510 and 512 in the direction of arrow F cause the first magnet receiving part 508 to move in the direction of arrow F. The movement of the first magnet receiving part 508 in the direction of arrow F causes the third connection part 514 to be moved in the direction of arrow F. Accordingly, the head portion 514*a* of the third connection part 514 has a contact with the metal protrusions 504*b*. Therefore, the contact of the head portion 514*a* with the metal protrusions 504*b* causes the electric wires 504*c* and 514*c* to be connected to each other, to thereby turn on the refrigerator lamp 27.

As mentioned above, the refrigerator lamp switch housing 225 is divided into the upper housing part 225*a* and the lower housing part 225*b* by the second magnet receiving part supporting part 600. In the same way that the lower housing part 225*b* has the structure of turning the refrigerator lamp 27 on and off as the fresh food door 210 is opened and closed, the upper housing part 225*a* has the structure for turning the freezing compartment lamp 230*a* on and off as the freezing door 200 is opened and closed.

As mentioned above, the upper housing part 225*a* has the same structure as the lower housing part 225*b*. Accordingly, the operations of the turning-on and turning-off the fresh food compartment lamp 230*a* are applied to the operations for turning on and off the freezing compartment lamp 240*a* in accordance with the opening and closing of the freezing door 200. At this time, the fourth magnet 200*b* of the freezing door 200 directly face the second magnet 220*b* of the second magnet receiving part 608 when the freezing door 200 is closed. Since the second and fourth magnets 220*b* and 200*b* have the same polarity, a repulsive force which is referred to as the second repulsive force, is generated between the second and fourth magnets 220*b* and 200*b*. Accordingly, the second magnet receiving part 608 retreats in the same direction to the freezing door 200, that is, in the direction of arrow E of FIG. 5A. As the second magnet receiving part 608 retreats, the second magnet receiving part 608 is supported by the second magnet receiving part supporting part 600. When the second repulsive force is eliminated as the freezing door 200 is opened, the second magnet receiving part 608 is forwarded in the movement direction of the freezing door 200, that is, in the direction of arrow F of FIG. 5B. When the second magnet receiving part 608 moves forward, the second magnet receiving part 608 is supported by the second magnet receiving part supporting plate 600.

By the retreating and forward movements of the second magnet receiving part 608, the head portion 614*a* of the sixth connection part 610 also retreats and moves forward in the sixth connection part receiving part 604. In accordance with the retreating and forward movements of the head portion 614*a,* the head portion 614*a* is in contact with or released from contact with the metal protrusions 604*b.* With the contact or the contact release of the head portion 614*a* as mentioned above, the electric wire 604*c* is connected with or disconnected from the electric wire 614*c* to turn the freezing compartment lamp 240*a* on or off.

As described above, the refrigerator equipped with a refrigerator lamp magnet switch according to the present invention has a smooth appearance since no protrusions are visible from the refrigerator body for switching refrigerator lamps on and off. Further, a lower production cost can be expected since the present invention performs the switching operations by the repulsive force between the magnets.

It is understood that various other modifications will be apparent to and can be readily made by those skilled in the art without departing from the scope and spirit of this invention.

Accordingly, it is not intended that the scope of the claims appended thereto be limited to the descriptions set forth herein, but rather that the claims be constructed as emcompassing all the features of the patentable novelty that reside in the present invention, including all the features that would be treated as equivalent thereof by those skilled in the art to which this pertains.

What is claimed is:

1. A refrigerator having a fresh food compartment and a freezing compartment for preserving food or the like in a fresh state and in a freezing state respectively, a fresh food door for the fresh food compartment and a freezing door for the freezing compartment for opening and closing of the fresh food compartment and the freezing compartment, a fresh food compartment lamp and a freezing compartment lamp for lighting the fresh food compartment and the freezing compartment, and for turning the fresh food compartment lamp and/or the freezing compartment lamp on and/or off in accordance with the opening and closing of the doors for the fresh food compartment and the freezing compartment, comprising:

an insulating partition having a receiving groove on the front side facing the fresh food door and the freezing door, and for dividing the inside of the refrigerator to form the freezing compartment and the fresh food compartment;

a refrigerator lamp switch housing having one open side and being inserted in the receiving groove;

a switch panel mounted on the front side of the insulating partition, and for covering the open side of the refrigerator lamp switch housing;

a switch housing division plate mounted in the refrigerator lamp switch housing, and for dividing the refrigerator lamp switch housing into an upper housing part and a lower housing part, wherein the switch housing division plate forms a second magnet receiving part supporting plate;

a first switching part constituted in the lower housing part and having a first magnet and a first plurality of springs, and for moving back and forth in the refrigerator as the fresh food door is opened and closed to turn the fresh food compartment lamp on and off, said first switching part including:

a first magnet receiving part having the first magnet, and for moving back and forth in the refrigerator by the first repulsive force between the first and third magnets and the restoring force of the first plurality of springs, a fresh food compartment lamp on/off switch part accommodating the first plurality of springs, and for turning the fresh food compartment lamp on and off in accordance with the back and forth movements of the first magnet receiving part, wherein the first plurality of springs are contracted and restored in accordance with the back and forth movements of the first magnet receiving part, and a first plurality of connection parts one ends of which are fixed to the first magnet receiving part and the other ends of which are movably inserted into the fresh food compartment lamp on/off switch part, wherein the first plurality of springs are contracted and restored by the other ends of the first plurality of connection parts in the back and forth movements of the first magnet receiving part; and a second switching part constituted in the upper housing part and having a second magnet and a second plurality of springs, and for moving back and forth in the refrigerator as the freezing door is opened and closed to turn the freezing compartment lamp on and off, wherein the second switching part is supported by the second magnet part supporting plate, the fresh food door has a third magnet to generate a first repulsive force between the first and third magnets as the fresh food door is closed, the freezing door has a fourth magnet to generate a second repulsive force between the second and fourth magnets, the movements of the first and second switching parts are performed by the first and second repulsive forces and restoring forces of the first and second plurality of springs.

2. The refrigerator as claimed in claim 1, wherein the first plurality of springs includes a first spring and a second spring.

3. The refrigerator as claimed in claim 2, wherein the first plurality of connection parts includes a first connection part, a second connection part, and a third connection part.

4. The refrigerator as claimed in claim 3, wherein the fresh food compartment lamp on/off switch part includes:

a first connection part receiving part having the first spring between the other end of the first connection part and a first rear side, and for movably receiving the other end of the first connection part, wherein the first rear side is a portion of the rear side of the refrigerator lamp switch housing;

a second connection part receiving part having the second spring between the other end of the second connection part and a second rear side, and for movably receiving the other end of the second connection part, wherein the second rear side is a portion of the rear side of the refrigerator lamp switch housing; and a third connection part receiving part for movably receiving the other end of the third connection part and turning the fresh food compartment lamp on and off by contacting and releasing the other end of the third connection part with and from metal protrusions, the other end of the third connection part having a first electric wire connected with the fresh food compartment lamp and made of a conductive material, the third connection part receiving part having the metal protrusions to be contacted with the other end of the third connection part as the third connection part moves forth by the restoring force of the first plurality of springs and having a second electric wire connected with an electric power supply.

5. The refrigerator as claimed in claim 1, wherein the second switching part includes:

a second magnet receiving part having the second magnet, and for moving back and forth in the refrigerator by the second repulsive force between the second and third magnets and the restoring force of the second plurality of springs;

a freezing compartment lamp on/off switch part accommodating the second plurality of springs, and for turning the freezing compartment lamp on and off in accordance with the back and forth movements of the second magnet receiving part, wherein the second plurality of springs is contracted and restored in accordance with the back and forth movements of the second magnet receiving part; and a second plurality of connection parts one ends of which are fixed to the second magnet receiving part and the other ends of which are movably inserted into the freezing compartment lamp on/off switch part, wherein the second plurality of springs are contracted and restored by the other ends of the second plurality of connection parts in the back and forth movements of the second magnet receiving part.

6. The refrigerator as claimed in claim 5, wherein the second plurality of springs include a third spring and a fourth spring.

7. The refrigerator as claimed in claim 6, wherein the second plurality of connection parts include a fourth connection part, a fifth connection part, and a sixth connection part.

8. The refrigerator as claimed in claim 7, wherein the freezing compartment lamp on/off switch part includes:

a fourth connection part receiving part having the third spring between the other end of the fourth connection part and a fourth rear side, and for movably receiving the other end of the connection part, wherein the fourth rear side is a portion of the rear side of the refrigerator lamp switch housing;

a fifth connection part receiving part having the fourth spring between the other end of the fifth connection part and a fifth rear side, and for movably receiving the other end of the fifth connection part, wherein the fifth rear side is a portion of the rear side of the refrigerator lamp switch housing; and a sixth connection part receiving part for movably receiving the other end of the sixth connection part and turning the freezing compartment lamp on and off by contacting and releasing the other end of the sixth connection part with and from metal protrusions, the other end of the sixth connection part having a third electric wire connected with the freezing compartment lamp and made of a conductive material, the sixth connection part receiving part having the metal protrusions to be contacted with the other end of the sixth connection part as the sixth connection part moves forth by the restoring force of the second plurality of springs and having a fourth electric wire connected with the electric power supply.

* * * * *